United States Patent [19]

Richardson

[11] 3,987,779

[45] Oct. 26, 1976

[54] FIREPLACE GRATE

[76] Inventor: Jack F. Richardson, 6814 N. Marcile Ave., Glendora, Calif. 91740

[22] Filed: Apr. 22, 1975

[21] Appl. No.: 570,541

[52] U.S. Cl. ..... 126/165

[51] Int. Cl.[2] ..... F23H 3/04

[58] Field of Search ..... 126/152 B, 164, 165, 126/336, 36, 120, 152, 163, 153, 154, 160, 166, 161; 110/1 F; D23/95

[56] References Cited

UNITED STATES PATENTS

| | | | |
|---|---|---|---|
| 354,380 | 12/1886 | Bourne | 126/164 |
| 362,648 | 5/1887 | Miller | 126/36 X |
| 2,889,824 | 6/1959 | Mancusi, Jr. | 126/164 |
| 2,926,657 | 3/1960 | Ford | 126/165 |
| 3,561,896 | 2/1971 | Riehl | 431/354 X |
| 3,756,218 | 9/1973 | Simpson | 126/165 X |
| D160,686 | 10/1950 | Bergeron | 126/165 |

FOREIGN PATENTS OR APPLICATIONS

| | | | |
|---|---|---|---|
| 512,301 | 1/1921 | France | 126/36 |
| 375,727 | 6/1932 | United Kingdom | 126/164 |

*Primary Examiner*—William E. Wayner
*Assistant Examiner*—Harold Joyce
*Attorney, Agent, or Firm*—Nilsson, Robbins, Dalgarn & Berliner

[57] ABSTRACT

A fireplace grate is disclosed for supporting logs, or other fuel, and incorporating a gas burner integrally in the structure of the grate. As disclosed, a plurality of cradle members, of tubular metal stock are affixed to a pair of transverse, support rails which are formed of similar material and include downwardly turned extensions to define the legs of the grate. The tubular stock is of substantially square cross section, forming the grate so that the surfaces are offset from the horizontal to shed ash. One of the rails incorporates end closures to define a passage which is vented by a series of spaced-apart gas jets. A coupling apparatus is affixed to supply the passage with combustible gas, the apparatus incorporating a metering device for limiting the flow rate of gas into the passage.

4 Claims, 4 Drawing Figures

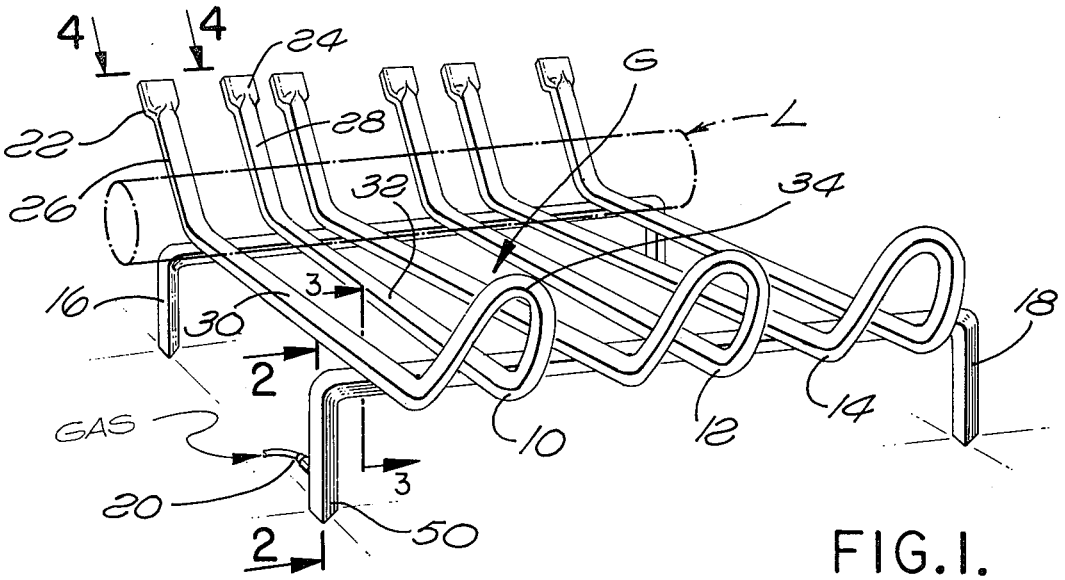
FIG. 1.
FIG. 2.
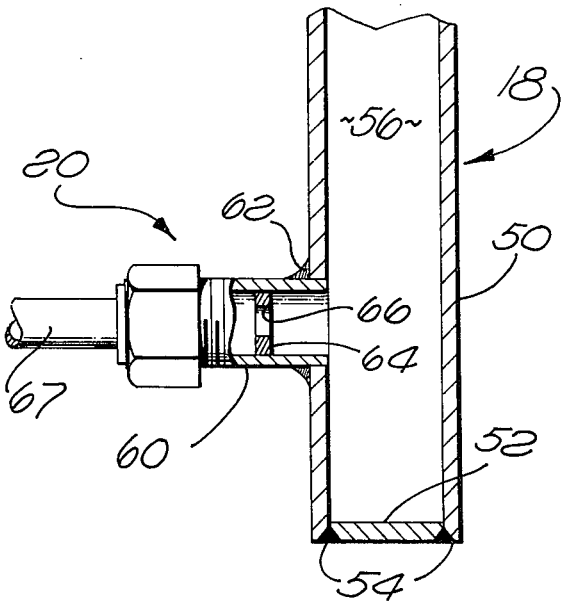
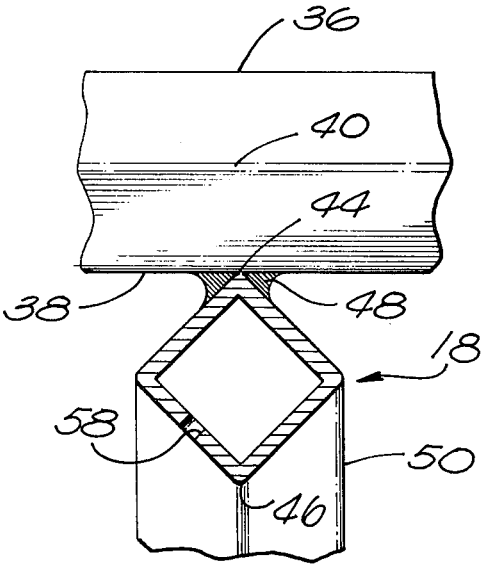
FIG. 3.
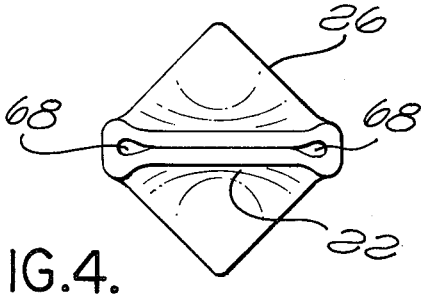
FIG. 4.

FIREPLACE GRATE

BACKGROUND AND SUMMARY OF THE INVENTION

Various forms of fireplace grates have been used since time immemorial for supporting logs or other fuel above a bed of ashes for improved combustion. Such grates are not only utilized in actual wood-burning fireplaces but additionally are commonly found in gas-burning fireplaces which simulate wood-burning fireplaces, for the purpose of supporting logs of ceramic, or other non-combustible material. Of course, simulated wood-burning fireplaces almost invariably incorporate some form of a gas burner. It is also widespread practice to provide a gas burner in actual wood-burning fireplaces for igniting the fuel to start a fire. Conventionally, gas burners in fireplaces are variously affixed to the grate to appropriately deliver flaming gas. Although such arrangements have been used for a number of years, certain difficulties and inconveniences are generally attendant their use of effectively operate over extended intervals of time.

The high temperatures to which fireplace grates and associated gas burners are subjected tend to be very corrosive. As these structures are generally formed of metal, their use over a significant time interval tends to produce oxidation and a scaling. As a related consideration, over extended intervals of use, the gas jets of the burner tend to clog and distort with resulting poor operation. Accordingly, a need exists for an improved fireplace grate and gas burner which is less susceptible to scaling and clogging. Other considerations in relation to such a structure include: economy of manufacture, ease of installation, characteristic appearance and ease of maintenance. In general, the present invention provides a fireplace grate incorporating a gas burner and which is substantially improved with regard to the above aspects of such units.

In general, the grate of the present invention incorporates a plurality of rails which support a plurality of cradle members above the ash bed of a fireplace. At least one of the rails is hollow to provide a passage for gas to a series of spaced-apart jets which are defined in and along the length of the rails. A coupling is affixed to the rail for supplying combustible gas. To improve the safety of the arrangement, in which a structural member also provides a gas duct, a metering device is incorporated in the coupling for limiting the gas pressure in the duct.

Grates constructed in accordance with the present invention are capable of operation at substantially lower temperatures thereby reducing the tendency of the metal to scale and oxidize. As will be apparent from the complete presentation set forth below, grates constructed in accordance with the present invention may also be economically manufactured, easily installed and maintained; furthermore such grates may be manufactured to provide a clean and attractive appearance.

BRIEF DESCRIPTION OF THE DRAWINGS

The drawings, disclosing an illustrative embodiment of the present invention to present the various advantages and objects hereof, are as follows:

FIG. 1 is a perspective view of a grate structure constructed in accordance with the principles of the present invention;

FIG. 2 is a partial sectional view taken along line 2—2 of FIG. 1;

FIG. 3 is a sectional view taken along line 3—3 of FIG. 1; and

FIG. 4 is a sectional view taken along line 4—4 of FIG. 1.

DESCRIPTION OF THE ILLUSTRATIVE EMBODIMENT

As indicated above, a detailed illustrative embodiment of the invention is disclosed herein. However, embodiments may be constructed in accordance with various other forms, some of which may be rather different from the disclosed illustrative embodiment herein. Consequently, the specific structural and functional details disclosed herein are merely representative, yet in that regard they are deemed to provide the best embodiment for purposes of disclosure and to establish a foundation as a basis for the claims herein which define the scope of the present invention.

Referring initially to FIG. 1, a log L is represented (in phantom) supported upon a grate G constructed in accordance with the present invention. Specifically, the log L rests upon three cradle members 10, 12, and 14 which are supported on a pair of transverse rails 16 and 18. As described in detail below, the rail 18 is hollow and incorporates a coupling 20 for receiving gas which is dispensed from jets that are spaced apart along the length of the rail 18. Accordingly, flaming gas is effectively provided to logs, e.g. log L, supported on the grate G, either to ignite such logs as fuel or, alternatively, to provide the appearance of combustion for simulated logs.

Considering the grate G in somewhat more detail, the cradle members 10, 12, and 14 are similar, each being formed of square cross-section steel stock to define a U-shaped configuration which is distorted at opposed ends. Considering the cradle member 10 in greater detail as representative, the terminal ends 22 and 24 (rear) are somewhat flattened (FIG. 4). Adjacent the ends 22 and 24, the cradle member 10 includes angular sections 26 and 28 which extend rearward and upward from horizontal lengths 30 and 32, which converge and are joined by a forward riser section 34. It should be noted that along the lengths of the cradle members 10, 12, and 14 an exterior corner is oriented upwardly. For example, the length 30 (FIG. 3) being of square cross section defines opposed upper and lower corners 36 and 38, respectively, and lateral corners 40. Consequently, the surfaces of the cradle members 10, 12, and 14 are substantially offset from the horizontal.

The rails 16 and 18 are also formed of square cross-section tubular stock (FIG. 3) which is oriented with upper and lower as well as lateral corners. Specifically, the rail 18 has an upper corner 44 horizontally disposed above a lower corner 46, which is affixed to each of the cradle lengths, e.g. length 30, by a weld 48. Thus, the surfaces of the rails 16 and 18 (as well as those of the cradle members 10, 12, and 14) are offset from the horizontal.

The ends of the rails 16 and 18 are turned downwardly in vertical extensions to define legs 50 which support the cradle members 10, 12, and 14 in elevated position, e.g. well above the ash bed in a fireplace. The legs 50 of the rail 18 are closed by square inserts 52 (FIG. 2) which are fixed in place by welds 54. Consequently, a duct or passage 56 is defined within the rail 18 for supplying gas to gas jets 58 (FIG. 3) which are defined along the horizontal length of the rail 18.

As illustrated in FIG. 2, the rail 18 receives combustible gas through the coupling 20. Specifically, a nipple 60 is affixed in one leg 50 of the rail 18 by a weld 62. Within the nipple 60, a metering member 64 is provided for defining a metering supply orifice 66. Generally, the area of the orifice 66 is defined to be substantially less than the aggregate area of the jets (FIG. 3) which are defined in the rail 18. As a consequence, the pressure within the passage 56 is maintained less than the line pressure of gas received at the coupling 20. In that regard, a coupling 20 as illustrated is adapted to engageably receive a supply line 67 for combustible gas.

In operation, a characteristic of the grate G is a reduced operating temperature, related of course to the grate size. That is, grates constructed in accordance with the present invention will involve structural members of larger cross section than are present in conventional solid-stock grates, due to the fact that such members in the grate of the present invention are hollow. As a consequence, substantially increased radiating surfaces are provided for the dissipation of heat. Furthermore, grates constructed in accordance with the present invention as disclosed herein tend to involve gaseous flow which further reduces operating temperatures. Specifically, the cradle members 10,12, and 14 are hollow as described above; however, at the ends 22 and 24, breather passages 68 are provided. That is, although the ends 22 and 24 are closed to avoid the accumulation of ash or other particles within the cradle member 10, air passages 68 exist which afford airflow and some interior cooling within the cradle member 10. Furthermore, the gas stream supporting combustion for the production of heat tends to be a cooling influence to some extent for the grate as it is received in the integrated structural rail 18.

As indicated above, the elements of the grate G avoid the presence of substantially horizontal surfaces. As a consequence, ash and dust are shed more freely and to some extent the grate tends to be self-cleaning. That is, the surfaces which are offset from the horizontal along with the relatively lower operating temperature of the grate tends to preserve surfaces from which ash and the like will readily fall.

In producing a grate in accordance with the present invention, the cradle members 10, 12, and 14 will normally be formed in a subassembly operation. Specifically, the square cross-section tubular stock for such members may be cut to length and formed to extend in three dimensions as described. In that regard, various forming jigs and fixtures may be employed as well known in the metal-forming arts. Either before or after the shaping operations for the cradle members 10, 12, and 14, the terminal ends 22 and 24 may be closed as by a stamping operation.

The rails 16 and 18 will also normally be formed as subassemblies and the initial forming steps for the rails may be similar. However, the forward rail 18 involves the further assembly of placing and fixing the inserts 52 and the coupling 20. As indicated above, welding techniques may be effectively employed in that regard. Such fastening techniques may also be effectively utilized for attaching the cradle members 10, 12, and 14 to the spaced-apart rails 16 and 18. Thus, the grate G may be manufactured for use.

Placement and connection of the grate G are relatively simple and involve merely affixing the line 67 (FIG. 2). Upon completion of such an operation, the grate may be employed effectively either to support logs L which are combustible fuel or alternatively which merely simulate combustible fuel. If the logs L are combustible, flaming gas (dispensed from the jets 58) may be effectively employed to ignite the logs L. Alternatively, in using logs L of ceramic, or the like, the flaming gas from the jets 58 presents the appearance of burning logs.

As indicated above, the embodiment described herein is deemed best for the purposes hereof; however, recognizing various modifications are apparent, the scope hereof shall be deemed to be defined by the claims as set forth below.

What is claimed is:

1. A fireplace grate structure for supporting logs or the like, incorporating a gas burner, comprising:

at least a pair of metal support rails of tubular metal, whereby at least one of which rails defines a passage for combustible gas and further defines a plurality of spaced-apart burner gas jets;

a coupling means affixed to said one support rail for supplying gas to said passage in said one support rail;

a plurality of tubular metal cradle members of U-shaped configuration the terminal ends being somewhat closed in a flat configuration, said members being affixed to extend between said rails for supporting said logs with said terminal ends exterior of one of said rails and said U-shaped sections exterior of the other of said rails.

2. A fireplace grate according to claim 1 wherein said coupling means comprises metering means defining a fixed orifice for limiting the rate of gas flow into said passage in said one rail.

3. A fireplace grate according to claim 1 wherein said support rails and said cradle members each are of substantially rectangular cross section.

4. A fireplace grate according to claim 3 wherein said rails and said cradle members are provided in said grate with angles of said rectangular cross sections oriented upward to provide the surfaces of said rails and cradle members offset from horizontal.

* * * * *